United States Patent [19]

Marton

[11] 3,987,589

[45] Oct. 26, 1976

[54] VACUUM ATTACHMENT FOR ABRADING MACHINE

[76] Inventor: Miksa Marton, 3620 Rankin St., Windsor, Ontario, Canada

[22] Filed: Mar. 3, 1975

[21] Appl. No.: 554,700

Related U.S. Application Data

[63] Continuation-in-part of Ser. No. 362,855, May 22, 1973, abandoned, and a continuation-in-part of Ser. No. 524,799, Nov. 18, 1974, Pat. No. 3,935,678, which is a continuation of Ser. No. 304,412, Nov. 7, 1972, abandoned.

[30] Foreign Application Priority Data

Aug. 2, 1972 Canada ..... 148535

[52] U.S. Cl. ..... 51/170 T; 51/273

[51] Int. Cl.[2] ..... B24B 23/02; B24B 55/06

[58] Field of Search ..... 51/170 T, 174, 177, 51/270, 273; 15/320, 385, 398, 399

[56] References Cited

UNITED STATES PATENTS

| | | | |
|---|---|---|---|
| 2,250,177 | 7/1941 | Boccasile | 15/320 |
| 2,618,008 | 11/1952 | Hageal | 15/399 |
| 3,256,648 | 6/1966 | Subonovich | 51/273 |
| 3,468,076 | 9/1969 | Jones | 51/273 |
| 3,673,744 | 7/1972 | Oimoen | 51/273 X |

FOREIGN PATENTS OR APPLICATIONS

| | | | |
|---|---|---|---|
| 1,085,064 | 7/1960 | Germany | 51/177 |
| 780,761 | 8/1957 | United Kingdom | 51/273 |

*Primary Examiner*—Al Lawrence Smith
*Assistant Examiner*—Nicholas P. Godici
*Attorney, Agent, or Firm*—Cushman, Darby & Cushman

[57] ABSTRACT

An abrader, such as a motorized disk sander, is provided with an annular chamber which surrounds the disk and which has a plurality of small openings proximate the work surface. A depending skirt on the chamber confines the abraded material. The mounting of the chamber provides for limited axial and rocking movement of the chamber with respect to the abrader to facilitate catching abraded material from curved work surfaces and in instances where the abrader is applied at an acute angle to the work surface. The motility also facilitates installation and removal of the attachment and of abrasive sheets to and from the disk of the abrader. By preference, the mounting provides for unlimited rotation of the abrading machine body with respect to the chamber. In one embodiment, the chamber is provided with an enlarged "slug catcher" opening for capturing larger pieces abraded from the work surface.

15 Claims, 4 Drawing Figures

Fig. 1.
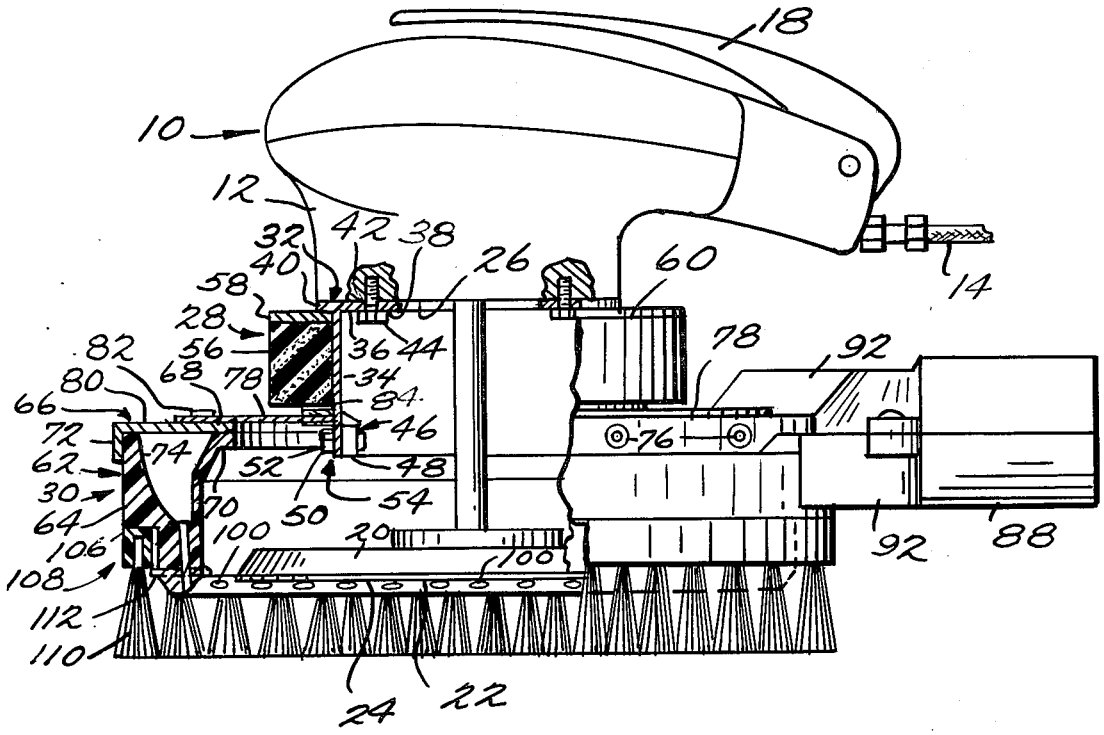
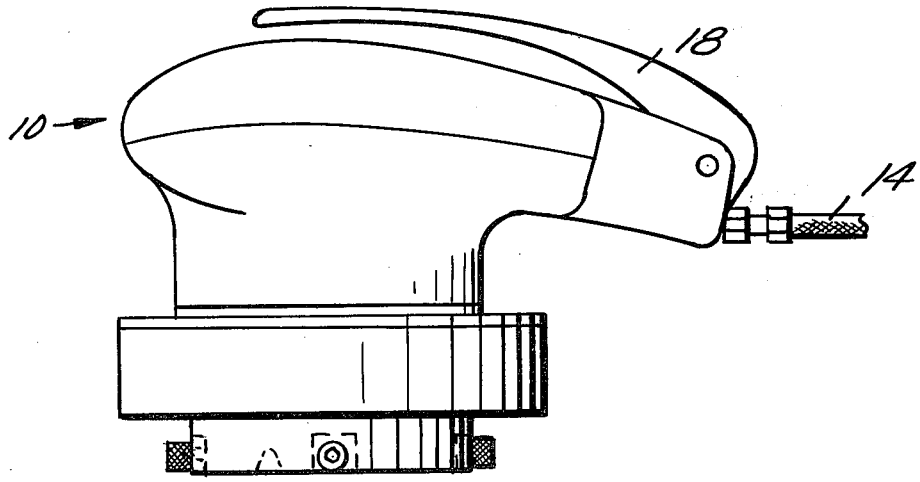
Fig. 3.

Fig. 2.
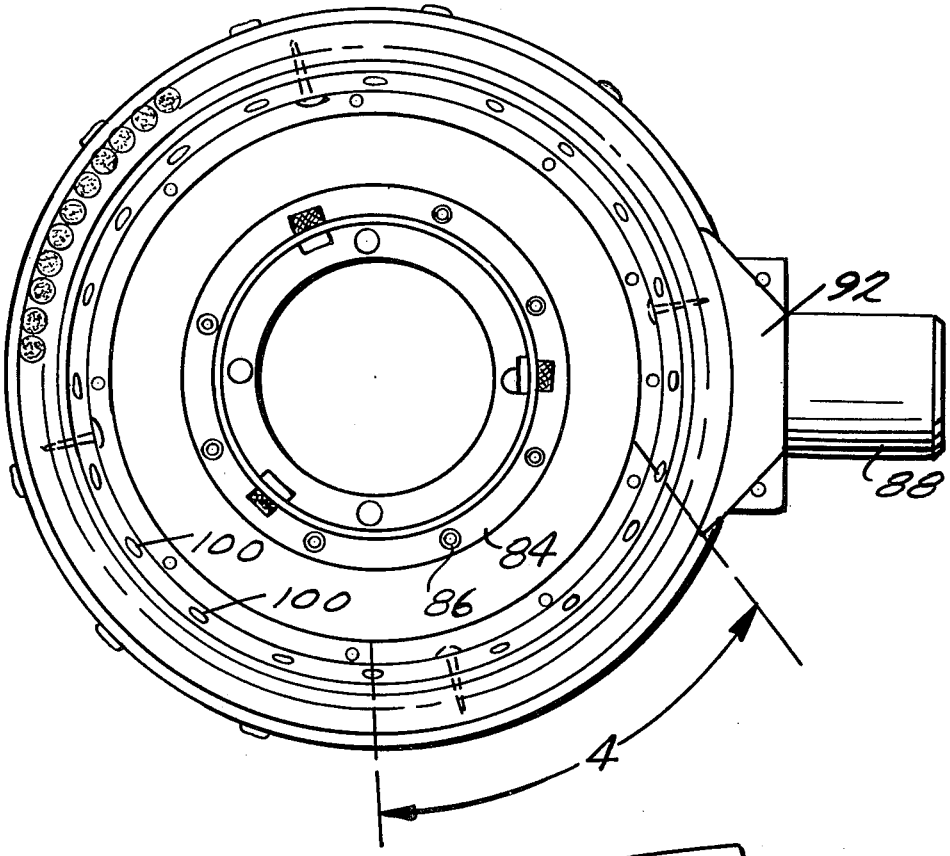
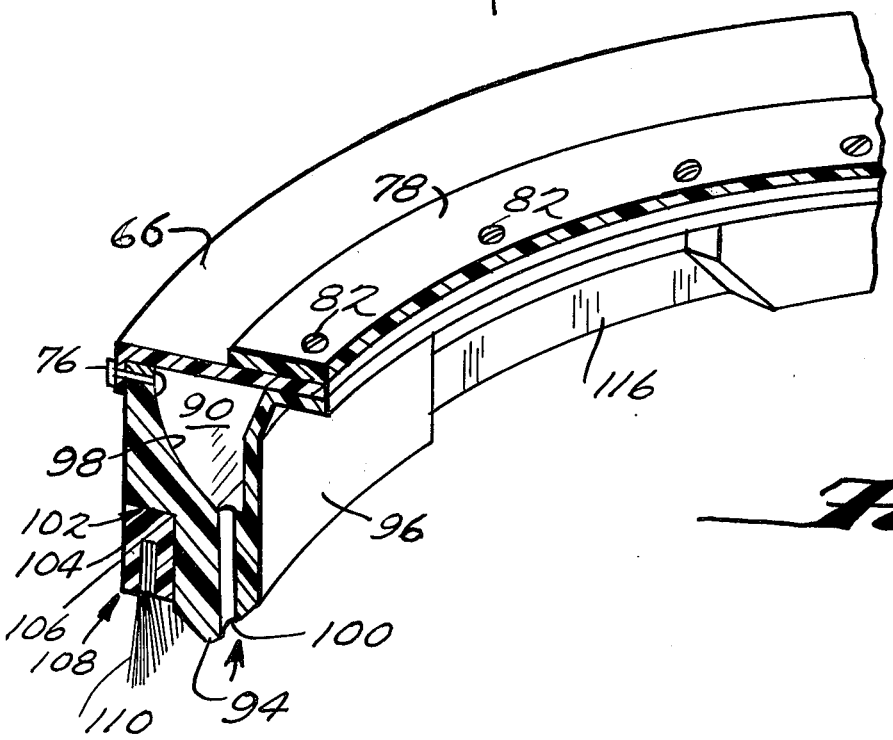
Fig. 4.

VACUUM ATTACHMENT FOR ABRADING MACHINE

CROSS REFERENCE TO RELATED APPLICATIONS

This is a continuation-in-part of my co-pending U.S. patent application, Ser. No. 362,855, filed May 22, 1973, and now abandoned in favor hereof. This is also a continuation-in-part of my co-pending U.S. patent application, Ser. No. 524,799, filed Nov. 18, 1974, now U.S. Pat. No. 3,935,678, as a full continuation of my earlier U.S. patent application, Ser. No. 304,412, filed Nov. 7, 1972, now abandoned.

BACKGROUND OF THE INVENTION

In my original application, Ser. No. 304,412, I disclosed an embodiment wherein the vacuum attachment includes an annular chamber with a generally triangular cross-section, of which a radially inner, upper apex was intercalated axially between a rigid flange and a resilient ring mounted on the abrading machine. This permitted some rocking limited and axial excursion of the chamber with respect to the abrader.

My next application, Ser. No. 362,855 disclosed two features I believed to be improvements on the original design. The mounting of the chamber was changed, the resilient ring and intercalation were replaced by securing an annular, flexible web at its outer extent to the chamber and at its inner extent to a mounting flange provided on the abrading machine. The hose connection for communicating vacuum to the chamber was moved to permit the chamber to be moved through 360 degrees with respect to the abrading machine.

During the prosecution of the foregoing applications and their Canadian and other foreign counterpart applications, the applicant has become aware of the following prior patents:

| | | |
|---|---|---|
| United States: | | |
| Thompson | 1,700,118 | January 22, 1929 |
| Vidal | 2,168,692 | August 8, 1939 |
| Hageal et al | 2,618,008 | November 18, 1952 |
| Subonovich | 3,256,648 | June 1966 |
| Wason | 3,330,537 | July 11, 1967 |
| Hyde | 3,375,540 | April 2, 1968 |
| Jones | 3,468,076 | September 23, 1969 |
| Danzig | 3,644,960 | February 29, 1972 |
| Oimoen | 3,673,744 | July 4, 1972 |
| Hughes | 3,686,707 | August 29, 1972 |
| Vinella | 3,701,221 | October 31, 1972 |
| Hutchins | 3,824,745 | July 23, 1974 |
| Foreign: | | |
| DBP (Germany) | 846,215 | August 11, 1952 |
| DBP (Germany) | 1,085,064 | December 29, 1960 |

In the automotive industry, welded seams, primer and other coatings are subjected to abrading action by hand-held machines, preparatory to further finishing operations. In many plants, the work has customarily been bathed in a water spray during abrading, but environmental concerns over disposal of the contaminated waste water has lead to the coversion of many plants from wet abrading to dry abrading for these tasks.

Widespread conversion to dry abrading is dependent upon the simultaneous solution of an environmental health and production problem: dry abrading releases particles of the abraded material into the air. Some of the material has been determined to represent a danger to health, if breathed. In addition, a dusty atmosphere is unwanted in an area where finishes are being applied, because some will settle upon automotive finishes which have just been applied, and spoil their smooth appearance.

Various hoods and vacuum chambers have been proposed by others for use with other scrubbing, cleaning, cutting or abrading equipment used in other contexts.

For instance, floor scrubbing machines have been provided with hoods for sucking spent cleaning solution and incorporated dirt from around a rotating scrubbing brush. A number of problems present in the automotive environment are absent in the floor cleaning environment. For example, the floor is flat and is addressed flatwise by the brush so the dirty solution is always being flung outwards along the same annular path. A chamber can be confidently fixed with respect to the floor cleaner to intercept that path. However, an automotive body has many curved surfaces, is often addressed at an acute angle by the abrading disk, and the disk often needs to be moved off the work surface at an edge, in order to abrade right to that edge. Accordingly, a vacuum chamber which is fixed on the abrading machine will often miss the path of the abraded material being flung off the work surface. And when the abrader is moved part-way off an edge, a vacuum chamber that consists of a hood which encloses the back and outer sides of the abrader, would loose effectiveness, because so large a part of its open underside would be off the work surface and open to the air.

Furthermore, whereas a floor being cleaned remains underfoot, an automotive body being finished needs attention to e.g., roof, quarter panel and trunk lid portions that are disposed at various heights and angular dispositions relative to the worker. Accordingly, whereas the connection of the vacuum line to the chamber may represent no obstacle to the worker using a floor cleaner, an automotive body finisher can find his working hindered by the vacuum hose.

While the present inventor sees a primary application of the invention in the automotive field, that application is by no means exclusive. It may find use in analogous instances where there is a need to prevent material which has been abraded from a surface from contaminating the air, from fouling the worker or the work area or from interfering with continued abrading work.

SUMMARY OF THE INVENTION

An abrader, such as a motorized disk sander, is provided with an annular chamber which surrounds the disk and which has a plurality of small openings proximate the work surface. A depending skirt on the chamber confines the abraded material. The mounting of the chamber provides for limited axial and rocking movement of the chamber with respect to the abrader to facilitate catching abraded material from curved work surfaces and to instances where the abrader is applied at an acute angle to the work surface. The mobility also facilitates installation and removal of the attachment and of abrasive sheets to and from the disk of the abrader. By preference, the mounting provides for unlimited rotation of the abrading machine body with respect to the chamber. In one embodiment, the chamber is provided with an enlarged "slug catcher" opening for capturing larger pieces abraded from the work surface.

The principles of the invention will be further hereinafter discussed with reference to the drawings wherein preferred embodiments are intended to exemplify, rather than limit, aspects of the invention as defined in the claims.

BRIEF DESCRIPTION OF THE DRAWINGS

FIG. 1 is a side elevation view of a typical hand-held, motor driven rotary disk abrader provided with a vacuum attachment in accordance with the principles of the invention. Parts of the vacuum attachment, of its mounting and of the abrader are broken away and sectioned to expose interior details.

FIG. 2 is a bottom plan view of the vacuum attachment and its mounting, assembled to one another, but removed from the abrader, and FIG. 3 is a fragmentary longitudinal sectional view of the mounting assembled on an abrader, but with the vacuum attachment removed.

FIG. 4 is a fragmentary perspective view, from the bottom, of a modified form of the vacuum attachment, corresponding to the region designated by the arrow marked 4 in FIG. 2. In this embodiment, an enlarged opening is provided to catch larger pieces, e.g., of weld material dislodged during the abrading process.

DETAILED DESCRIPTION

The typical abrader 10 includes a housing 12 containing a motor (not shown) powered by e.g. compressed air or electricity supplied through the line 14. The motor operates to turn the output shaft 16 so long as the worker holds the switch 18 in a depressed condition. In the instance depicted, a disk 20 is mounted on the lower end of the output shaft e.g. with a threaded socket having threading which tightens the disk on the shaft as the shaft rotates. Instead of being threaded, a conventional keying or radial set screw securement could be provided.

For some abrading operations, a sheet of abrasive material 22, is mounted directly on the outer face 24 of the disk 20. For others, a resilient backing member is interposed between the sheet and the disk. The sheet 22 may end at the outer edge of the disk, or, as is now conventional, it may include a cloth border which wraps around the edge of the disk. In these instances, the disk is provided with a radially outwardly facing circumferential groove. After the type of sheet is placed on the disk and its cloth skirt wrapped around the edge thereof, a garter spring is expanded and allowed to contract upon the cloth skirt at the level of the circumferential groove. Thus the spring retains the abrading sheet on the disk without need for any piercing of the abrading sheet.

The housing 12 is shown including a bottom wall 26 through which the shaft 16 protrudes. It is this wall 26 upon which the mounting is itself mounted.

Because these foregoing features are presently commercially available and are not part of the invention, they have been discussed briefly, without elaborate illustration.

In addition, the drawings show a mounting assembly 28 and a vacuum attachment 30, provided in accordance with the principles of the invention.

The mounting assembly 28 includes a mounting bracket 32, shown including a tubular body 34, for instance fabricated of sheet steel, and having an annular, radiating flange 36 of the same material secured at its upper end. The flange 36 includes a first portion 38 which extends radially inwardly from the body 34 and a second portion 40 which extends radially outwardly therefrom. The portion 38 is provided with suitably spaced holes 42 which permit the flange 36 to be bolted at 44 flatwise to the underside of the bottom wall 26 of the housing 12. Near the lower end thereof, the tubular body 34 is provided with a plurality of radiating, angularly spaced, internally threaded openings 46. In the instance depicted, these are formed by drilling holes through the sheet metal of the body 34, and brazing a nut 48 on the inside of the body 34 coaxially with each drilled hole. A screw 50 with a projecting head 52 is threaded into each opening 46 from the outside. Thus, the heads 52 of the screws 50, in composite, form an albeit angularly discontinuous, radially outwardly projecting ledge 54, the tubular body 34 near the lower extent of the tubular body 34. The mounting assembly 28 further includes a ring 56 of resilient material such as foam rubber, polyurethane foam plastic or the like siding fitted on the exterior of the tubular body 34 between the flange 36 outer portion 40 and the ledge 54 of screw heads 52. The ring 56 is, by preference substantially axially shorter than the distance between the flange portion 40 and the ledge 54. It is shown having a square cross-section. Also in the instance depicted, a flat ring 58 of fabric reinforced resilient rubber is interposed between the upper end 60 of the resilient ring 56 and the flange portion 40 as a wear protector for that end.

The vacuum attachment 30 includes a generally toroidal, hollow, housing 62. In the instance depicted the housing 62, which is of generally triangular transverse cross-section, is formed of two parts: a lower portion 64 of generally V-shaped transverse cross-section and a generally flat, ring-shaped cap 66. The inner, upper edge of the lower portion 64 and the inner edge of the cap 66 are provided with superimposed radiating flanges 68, 70. The outer edge of the cap 66 is provided with a depending peripheral skirt 72 which engages the outer upper edge region 74 of the housing portion 64. A plurality of angularly spaced fasteners such as rivets 76 are installed through the skirt 72 and edge region 47 where these elements overlap in a radial sense. A sealant is preferably applied within this overlapping region, as well as between the overlapping flanges 68, 70.

A flat ring 78 of flexible material such as fabric reinforced flexible rubber is provided on the upper surface 60 of the cap 66.

In the instance depicted, the ring 78 has an outer diameter intermediate the radially inner and outer extents of the cap 66, so that it overlies the flange 70. Fasteners such as a plurality of angularly spaced screws 82 are installed through the vertically overlapping regions of the flanges 68 and 70 and the flexible ring 78.

The flat ring extends radially inwardly substantially further than the flanges 68, 70 and is shown provided with a narrow, flat metallic wear protector ring 84 applied on the upper surface of the radially inner edge region thereof and secured thereon, for instance by rivets 86.

The diameter of the inner edge of the flexible ring 78 is slightly larger than the outer diameter of the tubular body 34 between the flange portion 40 and ledge 54.

It should be noticed that the housing 62 further includes a radially outwardly projecting tubular condiut 88 formed as an integral part thereof and communicating with the generally toroidal chamber 90 defined within the housing 62. The housing portions 64, 66 are shown being outwardly bulged somewhat at 92 where the tubular condiut 88 joins the chamber to avoid abruptly constricting the conduit and to permit the intersection to occur further up on the housing than would otherwise be the case.

The generally triangular cross-sectional shape of the housing 62 is arranged base-upwards, the base being provided by the cap 66, and apex downwards, the apex being shown at 94. Thus, from the base, the housing 92 has a radially inner side 96 and a radially outer side 98 extending down to the apex 94.

The inner side 96 near, but above the apex 94 is provided with a circumferentially extending series of generally downwardly and inwardly directed, angularly spaced openings 100 through the housing, into the chamber 90. Preferably, the cumulative cross-sectional area of the openings is less than the transverse cross-sectional area of the tubular conduit 88.

Thus, when the conduit 88 is connected to a hose leading to a vacuum pump means, a partial vacuum is drawn on the chamber 90 and a strong suction is drawn through the openings 100.

The outer side 98 of the housing is provided near, but above the apex 94 with a circumferentially extending recess 102 which is bordered at the top by a downwardly facing circumferential shoulder 104. The recess receives the ring-shaped base 106 of a skirt member 108. In the instance depicted, the skirt member 108 is a brush which includes a ring of bristles 110 depending from the base. When the base coaxially abuts the shoulder 104, the bristles depend e.g., one-half inch beneath the apex 94. Accordingly, when the assembled device 10, 28, 30 merely rests on a flat work surface, the extension of the bristles holds the apex 94 a short distance above the work surface, even though the bristles may flex and bend over somewhat.

The two major purposes for providing the skirt 106 are (1) to allow the worker to apply a scrubbing action to the work surface as the assembled device is moved thereacross in order to dislodge fine particles which have been abraded from the work surface, and (2) to confine within the space defined radially inwardly of the inner side 96 the particulate material which becomes airborne as it is abraded from the work surface, until that material is sucked into the chamber 90 through the openings 100. The skirt may serve to enhance the maintenance of suction when the device is presented against the work surface, but that is minor compared to the two described functions.

It should be apparent that abrasive action will tend to wear out the bristles before the remainder of the vacuum attachment 30 is used up. Accordingly, the skirt member 108 is preferably mounted in such a way that it may be easily removed and replaced, In the instance depicted, a plurality of screws 112 are screwed radially outwardly through the housing approximately at the level of the openings 100. The inner ends of the screws 112 emerge through the outer side 98 just below the base 106 of the skirt 108 and provide an, albeit, angularly discontinuous upwardly facing shoulder which supports the skirt. Accordingly, the skirt 108 may rotate with respect to the housing, but will remain in place until the screws 112 are threadably retracted for the purpose of removing and replacing the skirt. While a skirt consisting of a moulded plastic base having bristles depending therefrom is preferred, the skirt can be made of a base having a curtain of plastic sheeting, felt or the like could be used instead.

Where it will be of use in helping install and remove parts of the abrader, mounting or vacuum attachment, suitable additional features may be provided, such as openings or notches 114 through the tubular body 34.

When the mounting assembly 28 is mounted on an abrader 10 as described, the vacuum attachment may be easily installed and removed by installing and removing the bolts 44 as described. Due to the flexibility provided by the resilient ring 56, the flexible ring 78 and the somewhat greater axial length of the tubular body 34 between the flange portion 40 and the bolts 44 than the combined axial length of the resilient ring 56, the backing ring 58, the flexible ring 78 and protector ring 84, and due to the 360 degrees rotability of the vacuum attachment 30 with respect to the mounting assembly 28, the assembled device may be scrubbed back and forth and around on a flat or curved work surface, including over edge portions of the work surface, and the great bulk of the material abraded from the work surface will be sucked into the chamber 90 through the holes 100 and delivered to the vacuum line at 88. Even when the worker presses the device down hard, the fact that the holes 100 lie above the apex 94 and proximate the outer edge of the abrading sheet, ensures that the work surface will not stopper the holes 100 and that the holes will be positioned to intercept the particles abraded from the work surface.

Because the tubular conduit 88 extends radially outwardly, it can often be used as a handle. Thus a user may hold the switch 18 depressed with one housing-grasping hand, and hold the tubular conduit 88 with the other hand, for two-handed work.

Accordingly, for instances where the device is to be used in an environment where large pieces of material are expected to be dislodged from the work surface from time to time, for instance slugs of weld material about a centimeter across, the inner wall 96 may be provided with a "slug catcher" opening 116 as shown in FIG. 4. The opening 116 is preferably oval shaped, elongated angularly of the inner side 96, large enough to accept the largest slugs generally expected to be dislodged and placed and relatively sized as shown.

It should now be apparent that the vacuum attachment for abrading machine as described hereinabove possesses each of the attributes set forth in the specification under the heading "Summary of the Invention" hereinbefore. Because the vacuum attachment for abrading machine of the invention can be modified to some extent without departing from the principles of the invention as they have been outlined and explained in this specification, the present invention should be understood as encompassing all such modifications as are within the spirit and scope of the following claims.

What is claimed is:

1. For an abrader having a housing from which a rotatable work head protrudes, a vacuuming means for collecting material abraded from a work surface addressed by the work head, said vacuuming means including:

housing means defining a hollow, generally toroidal vacuum chamber having vacuum inlet conduit for connection to a vacuum source;

means defining a plurality of small angularly spaced, generally downwardly and inwardly directed openings into the vacuum chamber; and a mounting assembly for mounting the vacuum chamber on the abrader housing to surround the work head, with said openings proximate both the working surface and the periphery of the working head, the mounting assembly including means constituted by a flexible ring intercalating with a portion of the vacuum chamber housing means and permitting limited axial and rocking of the vacuum chamber with respect to the abrader housing and unlimited rotation of the vacuum chamber with respect to the abrader housing.

2. The vacuuming means of claim 1 further including a circumferentially extending skirt depending from the vacuum chamber housing radially outwardly of the openings, for confining abraded material under the vacuum chamber housing for collection through said openings.

3. The vacuuming means of claim 2 wherein the skirt comprises a ring of depending bristles which extend lower than the vacuum chamber housing for scrubbing contact with the work surface.

4. The vacuuming means of claim 1 wherein the vacuum inlet conduit is rigid and positioned to serve as a hand-grasped handle by a user of the abrader when equipped with said vacuuming means.

5. The vacuuming means of claim 1 wherein the vacuum chamber is of generally triangular shape with its base upwards and its apex downwards, so as to have an inner wall and an outer wall, the openings being provided through said inner wall near said apex.

6. The vacuuming means of claim 1 wherein the intercalating means of the mountng assembly includes two axially spaced ledge means provided on a tubular member, and a resilient ring backed by the uppermost of said ledge means.

7. The vacuuming means of claim 6 wherein the lower most of said ledge means is constituted by a plurality of screws threaded into radiating threaded opening means provided on the tubular member, whereby the vacuum attachment may be simply removed from the mounting assembly by removing said screws.

8. For an abrader having a housing from which a rotatable work head protrudes, a vacuuming means for collecting material abraded from a work surface addressed by the work head, said vacuuming means including:

housing means defining a hollow, generally toroidal vacuum chamber having vacuum inlet conduit for connection to a vacuum source;

means defining a plurality of small angularly spaced, generally downwardly and inwardly directed openings into the vacuum chamber; and a mounting assembly for mounting the vacuum chamber on the abrader housing to surround the work head, with said openings proximate both the working surface and the periphery of the working head, the mounting assembly including means intercalating with a portion of the vacuum chamber housing means and permitting limited axial and rocking of the vacuum chamber with respect to the abrader housing and unlimited rotation of the vacuum chamber with respect to the abrader housing;

a circumferentially extending skirt depending from the vacuum chamber housing radially outwardly of the openings, for confining abraded material under the vacuum chamber housing for collection through said openings;

at least one larger, generally oval-shaped opening, enlarged angularly of the vacuum chamber housing, provided above the lower extent of the vacuum chamber housing and positioned for opening generaly radially inwardly for catching larger slugs of material abraded from the work surface.

9. For a dry abrading machine that includes a work head mounted on a tool body which includes motor means for driving the work head in engagement with a work piece so as to remove particles from the work piece and to propel the removed particles outwrdly of the work head, generally parallel to the surface of the work piece which is being addressed, a vacuum attachment, comprising:

a generally toroidal member incorporating an annular hollow chamber having a vacuum inlet conduit extending therefrom;

means defining a perimetrically extending series of individual apertures through the generally toroidal member, communicating the hollow chamber with the inner side of the exterior of the generally toroidal member, above the lowermost extent of the generally toroidal member;

an outer peripheral skirt of downwardly projecting scrubbing elements secured to the generally toroidal member so as to extend at least as low as the lowermost extent of the generally toroidal member, radially outside the communication of the apertures with the inner side of the exterior of the generally toroidal member, and disposed for scrubbing contact with the work piece, to free particles which have been abraded from the work piece by the work head and to confine such particles so as to substantially prevent their escape until they are sucked up by said attachment;

retaining plate means including: a first portion having means thereon for securement thereof to the tool body; a second portion for extending generally axially from the first portion toward the work head, when the first portion is secured to the tool body; and a third, generally laterally extending portion;

said generally toroidal member including a flexible, generally radially inwardly extending portion;

a ring of resilient material generally coaxially received between the tool body and said flexible, generally radially inwardly extending portion of the generally toroidal member, the flexible, generally radially inwardly extending portion being generally coaxially received between the ring of resilient material and said third, generally laterally extending portion of the retaining plate means;

the flexible, generally radially inwardly extending portion lying radially adjacent the second portion of the retaining plate means, with radial spacing therebetween, whereby, when the attachment is mounted on the tool body, the generally toroidal member is disposed for limited axial and rocking movement ot maintain the apertures spatially oriented to suck in said particles which have been abraded from the work piece and propelled outwardly of the work head or freed by the scrubbing contract of said scrubbing elements with the work piece.

10. The dry abrading machine vacuum attachment of claim 9 wherein the third generally laterally extending portion of the retaining means extends radially outwardly; the second portion of the retaining plate means being generally tubular, and the ring of resilient material bridging the upper end of the radial spacing between said second portion and the flexible radially inwardly extending portion.

11. The dry abrading machine vacuum attachment of claim 9, wherein the scrubbing elements are constituted by bristles.

12. For a dry abrading machine that includes a disk-shaped work head mounted for spinning rotation on a tool body which includes motor means for driving the work head in abrading engagement with a surface of a work piece and to propel the removed particles radially outwardly of the spinning, disk-shaped work head, generally parallel to said surface of the work piece, a vacuum attachment comprising:

a ring member incorporating an annular hollow chamber having a vacuum inlet conduit extending therefrom;

means defining a perimetrically extending series of individual apertures through the ring member, communicating the hollow chamber with the inner side of the exterior of the ring member, above the lowermost extent of the ring member;

an outer peripheral skirt of downwardly projecting scrubbing elements secured to the ring member so as to extend at least as low as the lowermost extent of the ring member, radially outside the communication of the apertures with the inner side of the exterior of the ring member, and disposed for scrubbing contact with the work piece, to free particles which have been abraded from the work piece by the work head and to confine such particles so as to substantially prevent their escape until they are sucked up by said attachment;

retaining plate means including: a first portion having means thereon for securement thereof to the tool body; a second portion for extending generally axially from the first portion toward the work head, when the first portion is secured to the tool body; and a third, generally laterally extending portion;

said ring member including a flexible, generally radially inwardly extending portion;

a ring of resilient material generally coaxially received between the tool body and said flexible, generally radially extending portion of the ring member, the ring member flexible, generally radially extending portion being generally coaxially received between the ring of resilient material and said third, generally laterally extending portion of the retaining plate means;

the ring member, flexible, generally radially inwardly extending portion lying radially adjacent the second portion of the retaining plate means, with radial spacing therebetween, whereby, when the attachment is mounted on the tool body, the ring member is disposed for limited axial and rocking movement by engagement of the scrubbing elements with said surface of the work piece, to effect varying resilient compression of the ring of resilient material, to maintain the apertures in proper spatial orientation to suck in said particles which have been abraded from said surface of the work piece and propelled outwardly of the spinning, disk-shaped work head or freed by the scrubbing elements with the work piece.

13. For a dry abrading machine that includes a work head mounted on a tool body which includes motor means for driving the work head in engagement with a work piece so as to remove particles outwardly of the work head, generally parallel to the surface of the work piece which is being addressed, a vacuum attachment, comprising:

a ring member incorporating an annular hollow chamber having a vacuum inlet conduit extending therefrom;

said ring member including a flexible, generally radially inwardly extending mounting ring;

means defining a perimetrically extending series of individual apertures through the ring member, communicating the hollow chamber with the inner side of the exterior of the ring member, above the lowermost extent of the ring member;

an outer peripheral skirt of downwardly projecting scrubbing elements secured to the ring member so as to extend at least as low as the lowermost extent of the ring member, radially outside the communication of the apertures with the inner side of the exterior of the ring member, and disposed for scrubbing contact with the work piece, to free particles which have been abraded from the work piece by the work head and to confine such particles so as to substantially prevent their escape until they are sucked up by said attachment, whereby, the ring member may be disposed circumferentially surrounding the work head with the flexible mounting ring connected to the dry abrading machine and with the scrubbing elements in contact with said surface of the work piece for limited axial and rocking movement of the hollow chamber by varying the engagement of the scrubbing element with said surface of the work piece, to maintain the apertures in proper spatial orientation to suck in said particles which have been abraded from said surface of the work piece and propelled outwardly of the work head or freed by the scrubbing contact of said scrubbing elements with the work piece.

14. The dry abrading machine vacuum attachment of claim 13, wherein the scrubbing elements are constituted by bristles.

15. A dry abrading machine, including:

a work head;

a tool body;

means for mounting a work head on the body;

motor means on the tool body for driving the work head mounting means, to drive the work head, when so mounted, in engagement with a work piece so as to remove particles from the work piece and to propel the removed particles outwardly of the work head, generally parallel to the surface of the work piece which is being addressed, means for vacuuming-up said particles, comprising:

a ring member incorporating an annular hollow chamber having a vacuum inlet conduit extending therefrom;

means defining a perimetrically extending series of individual apertures through the ring member, communicating the hollow chamber with the inner side of the exterior of the ring member, above the lowermost extent of the ring member;

an outer peripheral skirt of downwardly projecting scrubbing elements secured to the ring member so as to extend at least as low as the lowermost extent of the ring member, radially outside the communication of the apertures with the inner side of the exterior of the ring member, and disposed for scrubbing contact with the work piece, to free particles which have been abraded from the work piece by the work head and to confine such particles so as to substantially prevent their escape until they are sucked up by said vacuuming-up means;

retaining plate means including: a first portion having means thereon securing the retaining plte means to the tool body; a second portion extending generally axially from the first portion toward the work head; and a third, generally laterally extending portion, said ring member including a flexible, generally radially inwardly extending portion;

a ring of resilient material generally coaxially received between the tool body and said flexible, generally radially inwardly extending portion of the ring member, the ring member flexible, generally radially inwardly extending portion being generally coaxially received between the ring of resilient material and said third, generally laterally extending portion of the retaining plate means;

the ring member flexible, generally radially inwardly extending portion lying radially adjacent the second portion of the retaining plate means, with radial spacing therebetween, whereby, the ring member is disposed for limited axial and rocking movement to maintain the apertures spatially oriented to suck in said particles which have been abraded from the work piece and propelled outwardly of the work head or freed by the scrubbing contact of said scrubbing elements with the work piece.

* * * * *